US005709423A

United States Patent [19]

Romero

[11] Patent Number: 5,709,423

[45] Date of Patent: Jan. 20, 1998

[54] FOOD GRIPPER UTENSIL

[76] Inventor: Ivan Romero, 6051 Devonshire Dr., Palmdale, Calif. 93536

[21] Appl. No.: 649,283

[22] Filed: May 17, 1996

[51] Int. Cl.[6] ..... A47G 21/10; A47J 43/28

[52] U.S. Cl. ..... 294/25; 294/16; 294/99.2

[58] Field of Search ..... 294/1.1, 3, 5, 8.5, 294/11, 16, 19.3, 25, 28, 31.1, 33, 99.2, 106, 118, 902

[56] References Cited

U.S. PATENT DOCUMENTS

| | | | |
|---|---|---|---|
| 1,882,934 | 10/1932 | Rogaczewicz | 294/11 |
| 2,001,346 | 5/1935 | Hays | 294/28 |
| 2,082,699 | 6/1937 | Keppinger | 294/3 X |
| 2,263,965 | 11/1941 | Fiori | 294/99.2 |
| 2,768,856 | 10/1956 | Wright | 294/33 X |
| 2,800,356 | 7/1957 | Benton | 294/106 |
| 3,138,211 | 6/1964 | Blom | 294/11 X |
| 3,259,415 | 7/1966 | Howard | 294/33 X |
| 4,577,900 | 3/1986 | Chasen | 294/16 X |
| 4,682,803 | 7/1987 | Andrews | 294/25 X |
| 4,728,139 | 3/1988 | Oretti | 294/99.2 |

FOREIGN PATENT DOCUMENTS

| | | | |
|---|---|---|---|
| 288890 | 6/1914 | Germany | 294/16 |
| 668263 | 11/1938 | Germany | 294/99.2 |
| 402605 | 12/1933 | United Kingdom | 294/11 |

*Primary Examiner*—Johnny D. Cherry
*Attorney, Agent, or Firm*—Chris Papageorge

[57] ABSTRACT

An eating utensil for gripping food such as chicken drumsticks is disclosed. The utensil has a pair of jaws which are shaped and dimensioned to accommodate two of the fingers and the thumb of a user enabling it to be manually closed. The utensil has a springy, hinge which acts to open the jaws upon release of finger pressure therefrom. The jaws have pairs of opposing rows of teeth, and the rows are outwardly curved to form a gap therebetween to accommodate the shape of the food and provide more secure gripping thereof. The pairs of rows of teeth are laterally and longitudinally oriented enabling the food to be gripped from either the front or side of the utensil. The pairs of rows of teeth are also positioned laterally and longitudinally adjacent each other and separated by recessed portions of the utensil enabling the food to be gripped at two portions thereof and thus more securely and firmly held.

21 Claims, 4 Drawing Sheets

FOOD GRIPPER UTENSIL

BACKGROUND OF THE INVENTION

The invention relates to utensils used for eating food and, more particularly, to such utensils for gripping and holding food to facilitate eating thereof.

Many types of foods are commonly eaten by gripping and holding the food between the fingers and thumb due to the awkwardness and inconvenience of eating these foods by means of the standard knife, fork and spoon eating utensils, Many people prefer to eat certain types of foods this way because it is faster and simpler than cutting these types of foods with a knife and fork into bite size pieces. However, one of the important drawbacks of eating this way is that holding food directly with the hands allows dirt, chemicals, germs, etc. to come into direct contact with food that is promptly ingested. Although washing the hands provides a degree of protection from the risks associated with this unsanitary practice, there nevertheless remains a significant risk of detriment to one's health therefrom. This is because all the germs cannot easily be washed or scrubbed from a person's hands especially the finger tips and underside of the fingernails. Bacteria clings tenaciously via electrostatic forces to a person's skin and thus cannot be easily rubbed off or washed off. In addition, not all types of soap are capable of destroying all the bacteria on a person's skin. Moreover, many people do not take the time and effort to effectively wash their hands thoroughly. Since a person's hands frequently come into contact with a variety of objects and body surfaces, this is consequently a significant way in which people can self-innoculate themselves with germs and thereby contract disease. Another detriment resulting from this unsanitary practice is that many people use a variety of industrial chemicals i.e., inks, solvents, etc., and household chemicals i.e., cleaning compounds, insecticides, etc., that are known to be harmful if ingested but nevertheless are useful for their commercial or home use and thus remain in common use. Some of the chemicals that people handle become imbedded in the skin of the hands and for this or other reasons remains on the skin even after washing, albeit perhaps in just trace amounts. Consequently, these chemicals can be transferred to the food and promptly ingested. This occurs to a much greater degree when eating certain foods that commonly contain copious amounts of oil such as deep fried chicken, french fries, etc. because the oil acts to emulsify these chemicals (as well as dirt and other types of contaminants) and thereby remove them from the hands and transfer them to the food. For this as well as other reasons, many people choose to use a napkin, paper towel, wax paper, etc. to cover the food before holding and eating it. However, the oil from the food often soaks through such covering wraps contaminating the user's fingers and negating the effectiveness of this more sanitary practice. Moreover, this practice typically requires the use of many such covering wraps for a meal resulting in a messy looking dining area and a lot of trash to clean up afterward.

In a effort to address this problem, many types of utensils have been designed to handle items of food. Some of these utensils include a pair of pivotally or hingedly connected arms, the opposing ends of which may be brought together into contact with each other and thus used to grip a piece of food therebetween. The opposing ends of many designs of such utensils include teeth to provide a means for gripping the food. An example of such a utensil is disclosed in U.S. Pat. No. 4,728,139 to Oretti. The Oretti utensil is a pair of tongs which have substantially similar length arms joined at their inner ends by an integral junction portion. The junction portion bears against a fulcrum block at the free end portions of the respective arms in order to relieve or eliminate bending stress on the junction. However, a primary disadvantage of the Oretti design is its complexity which makes it more expensive to manufacture. In addition, the teeth of the arms are straight and thus do not provide full contact with many types of food having bones and other curved portions.

Other such utensils have been specifically designed to hold certain types of foods. An example of such a utensil is disclosed in U.S. Pat. No. 4,802,704 to Burns. The Burns utensil consists of two oppositely disposed members pivotally joined at one end to simulate retractable jaws which are spring biased so that they are normally in an open position. The unjoined ends of the members are provided with opposing teeth for grasping a spare rib therebetween. One of the members is also provided with a ramp for guiding the spare rib to the jaws. Although the Burns holder can grasp the spare rib at only one location thereof, it's general dimensioning and wall structures act to retain the spare rib therein. However, a primary disadvantage of such holders is that they are suitable only for certain types of foods. In addition, as with the Oretti utensil, the Burns holder is somewhat complex in construction and thus not inexpensive to manufacture. Moreover, the hinge construction provides an area in which food particles (and therefore bacteria) may collect, hampering its rotational movement and making it unsuitable for reuse (although it is not inexpensive to purchase) because it is difficult to clean.

Other utensils are designed to be of one piece construction. U.S. Pat. No. 3,934,915 to Humpa discloses a one piece pair of tongs composed of plastic and provided with rows of teeth at the upper and lower end portions thereof. However, a primary disadvantage with the Humpa tongs are that the rows of teeth are flat and thus not shaped to conform to chicken drumstick bones or other types of food which have curved portions. Thus, the flat rows of teeth are able to grip the curved portion of the food i.e., the bone, at only one location resulting in a somewhat less than secure and rigid grasping thereof.

Some tong types of utensils have curved portions providing more secure gripping. Two examples of such utensils are disclosed in U.S. Pat. Nos. 4,577,900 and 4,877,280 to Chasen and Milano. The Milano tongs have convex gripping end surfaces and are used for picking up paper. The Chasen tongs are used for eating and have outer lateral knurled portions which are longitudinally curved to conform to the shape of the food or other thing to be gripped. However, the rows of teeth positioned inside the lateral portions are not curved. Moreover, only the front of the outer longitudinal portions are knurled thereby limiting the full grasping action of the tongs to foods gripped from the lateral sides. The front of the outer longitudinal portions is also straight rather than curved further limiting its full utility to grasping food from the lateral sides. In addition, the Chasen design utilizes two tong members joined together by a pin and also having spring loaded outer end portions. The design is thus not only complex but has areas i.e., the connections, which collect food and germs and which are difficult to properly clean. In addition, these connections can become clogged with food particles thereby impeding rotational movement of the tongs and compromising its utility.

What is needed is an eating utensil which is simple in construction having no connection points thereby rendering the utensil inexpensive to manufacture and relatively troublefree in use as well as providing no cleaning requirements or difficulties. What is also needed is such an eating utensil which provides enhanced versatility by allowing food to be gripped from the front or lateral sides of the utensil. What is additionally needed is such an eating utensil which provides firm and secure gripping of the food thereby enabling enhanced dextrous control of the food and thereby facilitating the job of eating the food.

SUMMARY OF THE INVENTION

It is a principal object of the present invention to provide an eating utensil which is simple in construction so that it is inexpensive to manufacture as well as easy and relatively troublefree to use.

It is another object of the present invention to provide an eating utensil which is shaped to accommodate a variety of sizes and shapes of food.

It is also an object of the present invention to provide an eating utensil which is able to firmly and securely grip food.

It is also an object of the present invention to provide an eating utensil which allows effective gripping of food from both the front and lateral sides thereof.

It is an object of the present invention to provide an eating utensil which is shaped and contoured to conform to the digit tips of the hand of a user to facilitate dextrous use thereof.

It is an object of the present invention to provide an eating utensil having a pair of jaws which are in an open position when the utensil is not being gripped by a user.

The eating utensil of the present invention is specifically designed to grip poultry parts such as chicken drumsticks, spare ribs and other types of food having bony parts. These types of foods are commonly eaten without the aid of utensils. However, since such foods typically contain copious amounts of oil or sauce, they have a slick surface which makes it more difficult for the diner to firmly hold them with his bare hand. But the food gripper utensil of the present-invention provides a convenient and easy to use means for eating such foods. The food gripper utensil has minimal moving parts and is simple in construction making it inexpensive to manufacture and purchase. This makes it particularly attractive as a disposable utensil and well suitable for use in restaurants, especially fast food and other types of take out restaurants.

The food gripper utensil is provided with opposing teeth which project inwardly from the outer end portions of the main body of the jaws of the utensil. The utensil is thus structured so that only the teeth contact the piece of food thereby enhancing the gripping effectiveness of the rows of teeth. The teeth are in rows which are oriented laterally and longitudinally so that the utensil is capable of gripping the food from either its front or lateral sides. This feature makes the utensil more versatile since some types or sizes of food pieces may more conveniently or effectively be gripped from the front or the lateral sides.

The rows of teeth also are located and positioned so that the teeth contact the chicken drumstick (or other suitable piece of food) at the upper and lower surfaces thereof at two separate locations thereby providing a firm grip on the drumstick. In order to so grip the food at two locations, the utensil has laterally oriented pairs of rows of teeth which are spaced from each other and parallel to each other. Thus, when the piece of food is grabbed from the front of the utensil, these teeth grip the upper and lower portions of the drumstick at two spaced locations thereof so that the drumstick is securely held by the diner. The diner can thus bite into the drumstick without worry or concern that the drumstick will slip out of the utensil or move around within the utensil thereby making the eating experience more difficult.

There are also longitudinally oriented pairs of rows of teeth similarly spaced laterally. This positioning enables the piece of food to be grabbed from the lateral sides of the utensil and similarly grip the upper and lower portions of the drumstick at two spaced locations thereof so that the drumstick is securely held by the diner.

Pieces of food that are typically eaten without conventional utensils such as chicken parts and ribs have curved bone surfaces. Consequently, in order to conform to the shape and contour of these food pieces, each of the rows of teeth are outwardly curved to provide an arc of contact between the teeth and the food. The curvature of the rows of teeth act to secure the food in position between the jaws by providing more points of contact between the teeth and the food. The increased number of points of contact act to generally minimize movement between the food and the utensil by increasing the frictional forces therebetween. Additionally, the curvature of the rows of teeth directs the gripping forces exerted by the user in a more horizontal direction thereby minimizing sideways movement of the food within the utensil. The horizontal component of the gripping forces exerted by the user minimizes lateral slippage of the food within the utensil thereby providing more secure and firmer gripping of the food. Eating the drumstick (or other suitable type of food) thus becomes relatively easy especially in comparison with bare hand eating of such foods which are typically slippery due to the oil or sauces. The food gripper utensil thus provides dexterity to the task of eating chicken drumsticks and other suitable foods.

DETAILED DESCRIPTION OF THE PREFERRED EMBODIMENT

Figure 1:
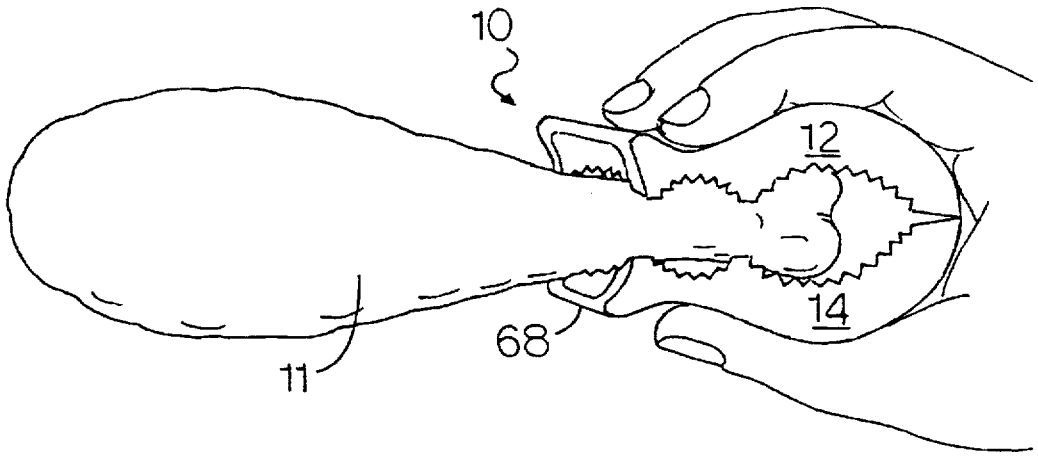
FIG. 1 is a perspective view of the food gripper utensil of the present invention showing a user's hand grasping the utensil and the jaws of the utensil gripping a drumstick.
Figure 2:
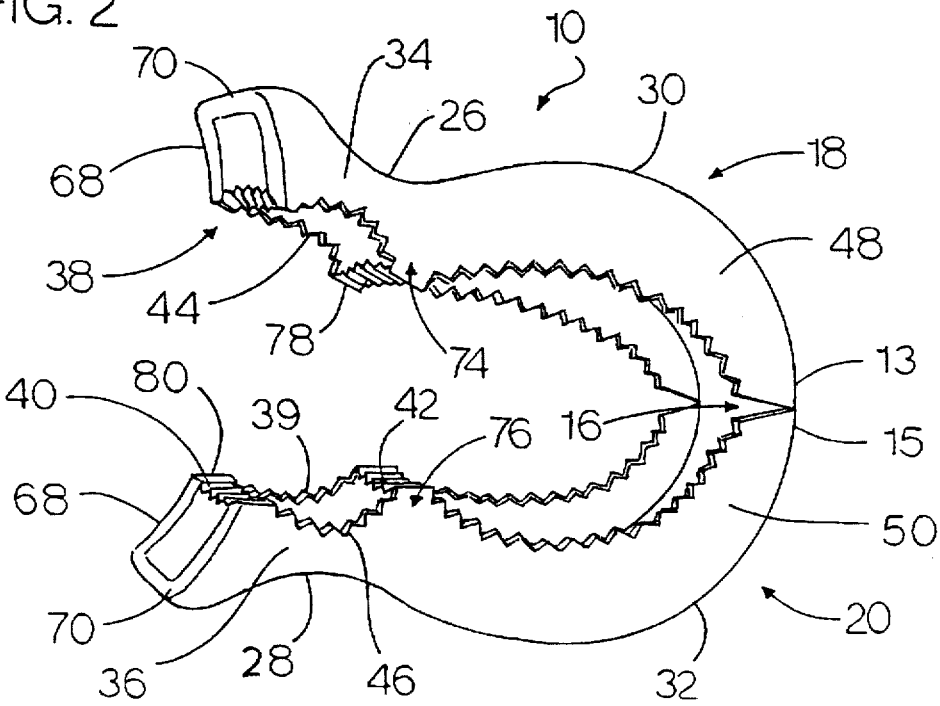
FIG. 2 is a perspective view of the food gripper utensil showing the jaws thereof in a partly open position.

Referring to the drawings, the present invention is an eating utensil for gripping food and is generally designated by the numeral 10. The food gripper utensil 10 is adapted to be positioned between a user's fingers (or finger) and thumbs, as shown in FIG. 1. The utensil is preferably approximately one and seven-eighths inches in length, seven-eighths inches in height at the front, one and one-eighth inches in height at the rear, three-quarters inches in width at the front and one and one-quarter inches in width at the rear to generally conform to the size and shape of the forefinger and thumb (more specifically, the front portions thereof) of an average size user. The utensil 10 includes a pair of jaws 12 and 14 which are rotatably interconnected at their rear ends 13 and 15 by a hinge 16. The hinge 16 is preferably integral and unitary with the jaws 12 and 14 and is preferably a piece (or sheet) of plastic or other suitable flexible material which allows bending thereof so that the jaws 12 and 14 can open and close. The hinge 16 is also preferably composed of a material which has memory so that after the hinge is bent it tends to revert back to its extended shape and position. Thus, due to the hinge 16, the pair of jaws 12 and 14 have a springy feel when closed manually and spring back to their open (or extended) position upon release of the manual pressure exerted thereon. This allows the jaws 12 and 14 to be in an open position normally and when the utensil is grasped and ready to be positioned around the end of a chicken drumstick 11 (or other such suitable piece of food). The springy characteristic of the hinge 16 is not of such a high degree that it presents inordinate resistance to closing the jaws 12 and 14 manually. In addition, the open position in which the jaws and the hinge are normally, i.e., absent manual closing pressure exerted on the jaws 12 and 14, is not that in which the jaws 12 and 14 and the hinge 16 are fully extended i.e., straight, but rather at approximately a ninety degree angle, as illustrated in FIG. 2. In such a partly open position, the utensil 10 is sufficiently open to allow it to be easily positioned around a piece of food but not open to such an extent that it is awkward for the user to grasp and hold the utensil in his hand ready for use.

Figure 3:
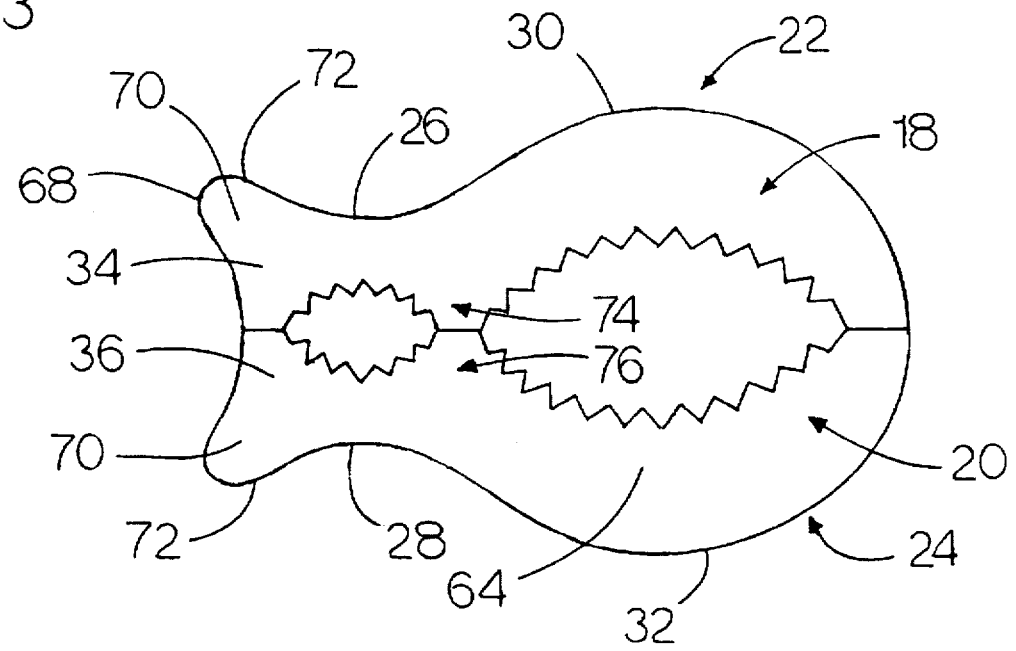
FIG. 3 is a side view of the food gripper utensil showing the contouring of the outer surfaces thereof and the curvature of the rows of teeth.

The pair of jaws 12 and 14 have main bodies 18 and 20. The main bodies 18 and 20 have outer surfaces 22 and 24 which have depressions 26 and 28 and raised portions (or humps) 30 and 32 located rearward of the depressions, as shown in FIG. 3. The depressions 26 and 28 preferably have a radius of curvature of approximately one-half of an inch and an arc of curvature of approximately fifty degrees so that they have the degree of curvature and dimensioning selected to conform to a user's finger tips and thumb tips. The raised portions 30 and 32 are preferably raised approximately one-quarter of an inch from the depressions and have a radius of curvature of approximately five-eighths inches and an arc of curvature of approximately ninety degrees so that they conform to the contours of a user's fingers and thumbs particularly at the forward portions thereof. The depressions 26 and 28 in conjunction with the raised portions 30 and 32 thus conform to the shape of the user's digits and fit therebetween in general full contact with the user's digits thereby enabling more dextrous use of the utensil. The particular curvatures and dimensions of the depressions 26 and 28 and raised portions 30 and 32 also enable the user's digits to apply a downward as well as rearward pressure on the jaws 12 and 14 enabling the user to apply a secure grip and have a secure hold on the utensil 10 thereby enhancing the dextrous use thereof.

The upper jaw 12 has a front end portion 34 and the lower jaw 14 has a front end portion 36 provided with teeth 38 for gripping the food. The teeth 38 each have a center line which is vertically oriented. The teeth 38 each also have pointed portions 39 which extend horizontally i.e., the pointed portions 39 extend in a horizontal line.

Figure 6:
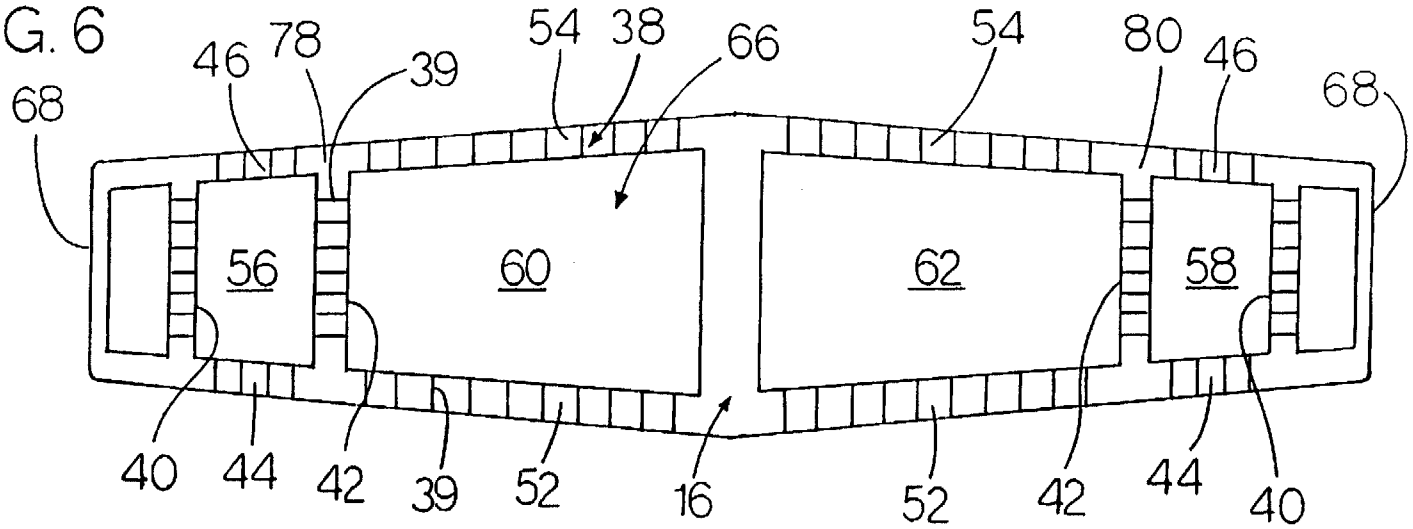
FIG. 6 is a top view of the food gripper utensil in a fully open position showing the relative positioning of the rows of teeth thereof.
Figure 7:
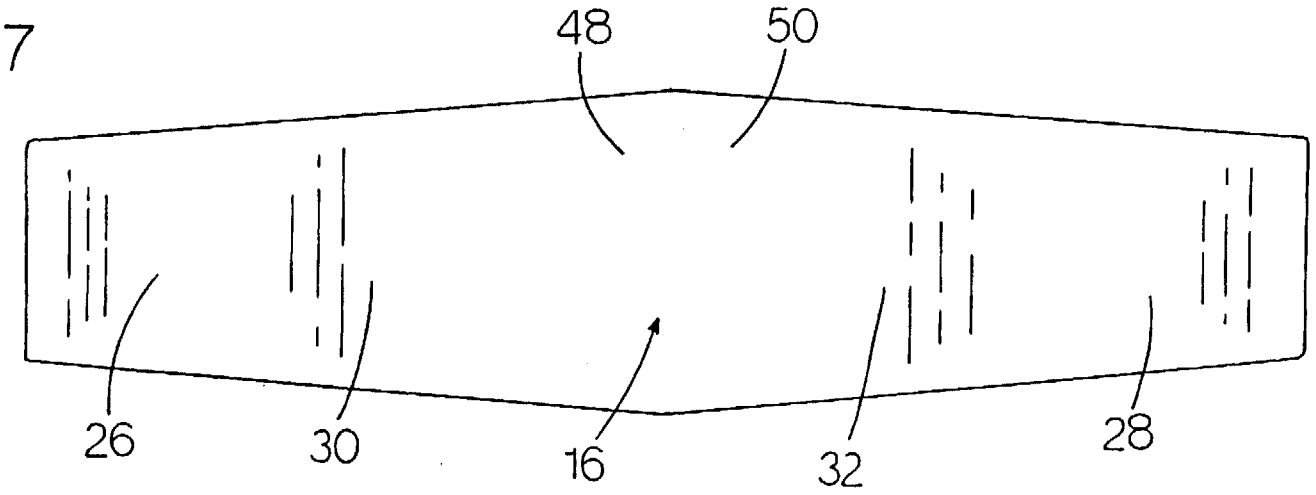
FIG. 7 is a top view of the food gripper utensil in a fully open position showing the contoured outer surfaces thereof and the general shape of the utensil.

The front end portions. 34 and 36 have preferably two pairs (or set of pairs) of rows of opposing teeth 40 and 42, and these opposing rows 40 and 42 are preferably laterally oriented and longitudinally spaced from each other a distance of approximately two-thirds of an inch such that row 42 is rearward of row 40, as shown in FIGS. 2, 3 and 6. These rows 40 and 42 are preferably approximately parallel to each other. The pointed portions 39 of the teeth 38 of rows 40 and 42 preferably extend longitudinally. The spacing and positioning of these rows 40 and 42 enable the jaws 12 and 14 to grip a piece of food such as a drumstick 11 at two locations of the end portion of the drumstick 11 and at both the upper and lower sides of the end portion at these two locations, as shown in FIG. 1. This enables a more secure and firmer grip to be made on the drums-tick 11.

The opposing rows of teeth 40 and 42 preferably are provided with a curvature having a radius of curvature of approximately one-half inches and an arc of curvature of approximately ninety degrees. The outward curvature of the rows of teeth 40 and 42 thus provide gaps 82 therebetween. This degree and dimensioning of the curved rows 40 and 42 are selected to accommodate foods (within the gaps 82) typically eaten without conventional eating utensils such as chicken drumsticks and wings, spare ribs and the like and, more particularly, to conform to the size and shape of average size pieces of such foods. Such foods typically have bony portions which have curved surfaces such that the curved rows 40 and 42 generally conform to these curved bony surfaces providing more points of contact between the foods and the rows 40 and 42 and thereby enhanced gripping effectiveness thereof and particularly lateral gripping effectiveness.

The front end portions 34 and 36 also have two pairs (or set of pairs) of opposing rows of opposing teeth 44 and 46 which are longitudinally oriented and laterally spaced from each other a distance of approximately two-thirds of an inch, as shown in FIGS. 2, 3 and 6. The pointed portions 39 of teeth 38 of rows 44 and 46 preferably extend laterally. The rows 44 and 46 are skewed rearwardly from each other at an angle of approximately fifteen degrees. As with the laterally oriented rows 40 and 42, the spacing and positioning of these rows 44 and 46 enable the jaws 12 and 14 to grip a piece of food such as a drumstick 11 at two locations of the end portion thereof and at both the upper and lower sides of the end portion at these two locations thereby providing a firmer and more secure grip to be made on the drumstick 11.

As with rows 40 and 42, rows 44 and 46 preferably are provided with a curvature to accommodate foods which have curved portions (typically because they include bones). The rows 44 and 46 have a radius of curvature of approximately nine thirty-seconds inches and an arc of curvature of approximately one hundred degrees. The outward curvature of the rows of teeth 44 and 46 thus provide and at least partly define gaps 84 therebetween. This degree and dimensioning of the curved rows is a little different than of rows 40 and 42 so that together they can accommodate a wider range of sizes and shapes of foods typically eaten without conventional eating utensils.

Figure 4:
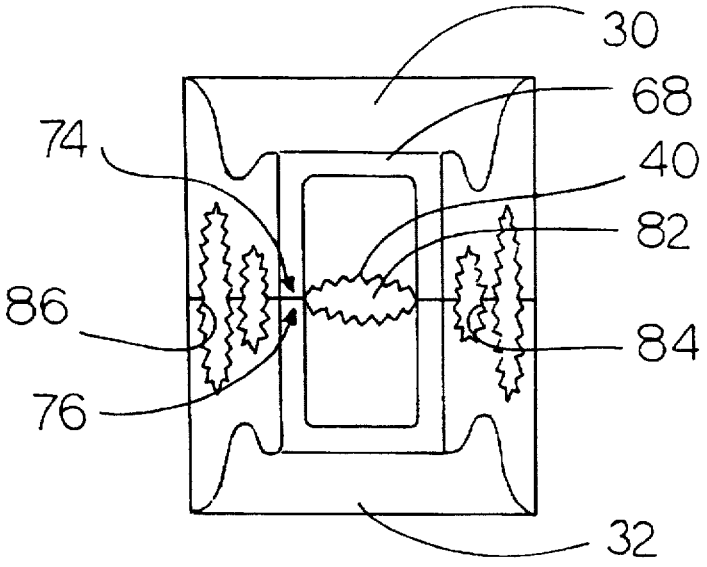
FIG. 4 is a front view of the food gripper utensil showing the curvature of the rows of teeth.
Figure 5:
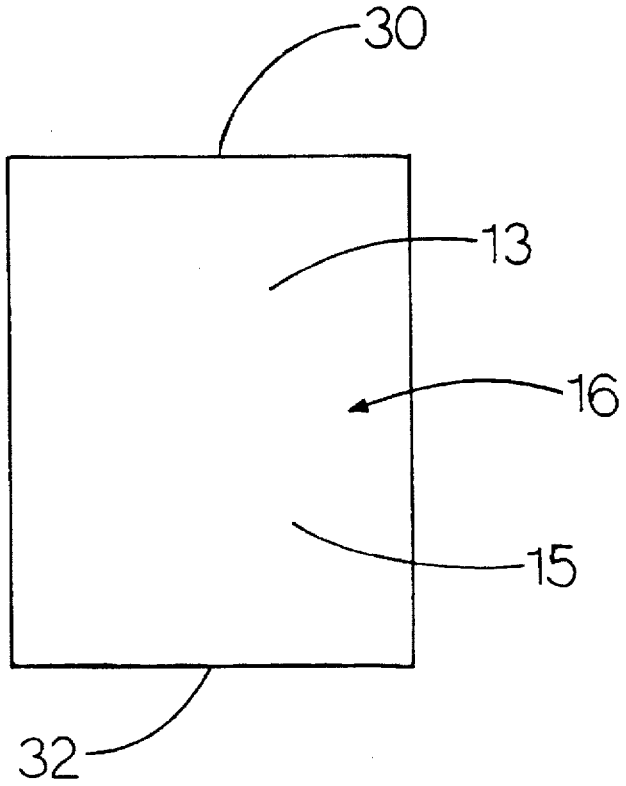
FIG. 5 is a rear view of the food gripper utensil showing the integral and unitary hinge component thereof.

The jaws 12 and 14 also have rear end portions 48 and 50 which also have two pairs (or set or pairs) of opposing rows of opposing teeth 52 and 54 which are positioned rearwardly of and adjacent to rows 44 and 46. The rows 52 and 54 are longitudinally oriented and laterally spaced from each other a distance of approximately three-quarters of an inch at their narrowest separation points and one inch at their widest separation points, as shown in FIGS. 2, 4 and 6. The pointed portions 39 of teeth 38 of rows 52 and 54 preferably extend laterally. As with rows 44 and 46, the rows 52 and 54 are skewed rearwardly from each other at an angle of fifteen degrees. As with the longitudinally oriented rows 44 and 46 as well as laterally oriented rows 40 and 42, the spacing and positioning of these rows 52 and 54 enable the jaws 12 and 14 to grip a piece of food such as a drumstick 11 at two locations of the end portion thereof and at both the upper and lower sides at these two locations thereby providing a firmer and more secure grip to be made on the drumstick 11.

As with rows 44 and 46, rows 52 and 54 preferably are provided with a curvature to accommodate foods which have curved portions (typically because they include bones). The rows 52 and 54 have a radius of curvature of approximately nine-sixteenths inches and an arc of curvature of approximately ninety five degrees. The outward curvature of the rows of teeth 52 and 54 thus provide and at least partly define gaps 86 therebetween. This degree and dimensioning of the curved rows is a little different than that of rows 40, 42, 44 and 46 so that together they can accommodate a wider range of sizes and shapes of foods typically eaten without conventional eating utensils such as chicken drumsticks and wings, spare ribs and the like.

The main body 18 of upper jaw 12 has a recessed portion 56 situated between the rows 40, 42, 44 and 46 thereof, as shown in FIG. 6. Similarly, the main body 20 of lower jaw 14 has a recessed portion 58 situated between the rows 40, 42, 44 and 46 thereof, also as shown in FIG. 6. The main body 18 of upper jaw 12 also has a recessed portion 60 located rearward of recessed portion 56 and situated between the rows 42, 52 and 54 thereof. Similarly, the main body 20 of lower jaw 14 also has a recessed portion 62 located rearward of recessed portion 58 and situated between the rows 42, 52 and 54 thereof. The recessed portions 56, 58, 60 and 62 in effect allow the rows of opposing teeth 40, 42, 44, 46, 52 and 54 to project inwardly from the main bodies 18 and 20 (toward the drumstick 11 when placed between the jaws 12 and 14) thereby isolating utensil/food contact to the teeth 38 and the food. This feature thus precludes contact between the drumstick 11 and any part of the jaws 12 and 14 other than the teeth 38 which would otherwise compromise the effectiveness of the grip afforded by the utensil 10. The rows of teeth 40, 42, 44, 46, 52 and 54 are mounted on walls 64 of the main bodies 18 and 20. The recessed portions 56, 58, 60 and 62 are defined by the walls 64 and inner surfaces 66 of the main bodies 18 and 20.

The jaws 12 and 14 also have a pair of lips 68 at the outer ends 70 thereof. The pair of lips 68 are recessed from the rows of teeth 40 so as to generally preclude or minimize contact between the drumstick 11 and the lips 68 and thereby minimize interference with the gripping function of the teeth 38. The pair of lips 68 also act to guide the drumstick 11 into the front of the utensil 10 and prevent the user's digit tips from contacting the drumstick 11. In addition, the outer portions 72 of the pair of lips 68 are raised from the depressions 26 and 28 (but the raised portions 30 and 32 are raised from the outer portions 72) and generally conform to the shape and contour of the digit tips and/or fingernails of the user's hand thereby enhancing longitudinal manual control of the utensil.

The pair of jaws 12 and 14 also preferably have projections 74 and 76, respectively, which project inwardly from the main bodies 18 and 20. The projections 74 of the upper jaw 12 and the projections 76 of the lower jaw 14 have projection flat top surfaces 78 and 80, respectively, which are higher than the rows of teeth 40, 42, 44, 46, 52 and 54. The projection flat top surfaces 78 of the upper jaw 12 contact and thereby mate with the projection flat top surfaces 80 of the lower jaw 14 when the jaws are closed. Thus, the teeth 38 of the opposing rows do not touch each other when the jaws 12 and 14 are closed.

The utensil 10 is preferably unitary such that all the components thereof are integral with each other. The utensil 10 is also preferably composed of a suitable plastic material. These features enable the utensil 10 to be inexpensive to manufacture and purchase.

Accordingly, there has been provided, in accordance with the invention, a utensil for gripping and eating food that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

What is claimed is:

1. A utensil for gripping food, comprising:

a pair of jaws rotatably interconnected so that said pair of jaws may be manually closed on the food, said pair of jaws having pairs of rows of opposing teeth, each pair of said pairs of rows of teeth outwardly curved to form a gap therebetween accommodating a desired portion of the food therein, said pair of jaws having outer surfaces which are entirely and continuously contoured and dimensioned to provide depressions and raised portions conforming to and accommodating a user's digits to provide full contact with entire front portions including tips of the user's digits in order to facilitate manual closure of said pair of jaws.

2. The utensil of claim 1 further including projections mounted on said pair of jaws and positioned between said pairs of rows of teeth, said projections projecting inwardly and away from adjacent said pairs of rows of teeth and opposing each other in order to mate with each other and thereby preclude said opposing teeth from contacting each other when said pair of jaws are in a closed position.

3. The utensil of claim 1 wherein each of said pair of jaws has recessed portions situated between said pairs of rows of opposing teeth to isolate contact between the pair of jaws and the food to the teeth and the food.

4. The utensil of claim 1 wherein said depressions are positioned forward of a portion of said pairs of rows of opposing teeth to enhance gripping effectiveness thereof.

5. The utensil of claim 4 wherein said outer surfaces include raised portions situated rearward of said depressions and outer portions situated forward of said depressions and raised therefrom, said raised portions raised to a greater degree than said outer portions in order to conform to curvature of digits of the user and direct finger pressure rearwardly to enhance firm holding of said pair of jaws and facilitate manual closure of said pair of jaws thereby enhancing gripping effectiveness thereof.

6. The utensil of claim 1 wherein said pair of jaws have a pair of lips at a front end portion thereof, said pair of lips positioned forward of said pairs of rows of teeth and recessed outwardly therefrom in order to function as a guide to facilitate placement of said pair of jaws over the food and within the gap of at least one of said pairs of rows of teeth.

7. The utensil of claim 1 further including a hinge interconnecting said pair of jaws at rear end portions thereof, said hinge exerting a force on said pair of jaws acting to at least partly open said pair of jaws in the absence of manual pressure exerted thereon.

8. The utensil of claim 7 wherein said hinge is unitary and integral with said pair of jaws and has sufficient flexibility to allow bending thereof upon exertion of manual pressure on said pair of jaws and thereby closure of said pair of jaws and has memory so that said hinge reverts to an extended position upon release of manual pressure on said pair of jaws thereby at least partly opening said pair of jaws.

9. The utensil of claim 1 wherein each of said teeth has a center line which is normal to a plane extending in longitudinal and lateral directions with respect to the utensil.

10. The utensil of claim 1 wherein said teeth have pointed portions which lie in a plane extending in longitudinal and lateral directions with respect to the utensil.

11. A utensil for manually gripping food, comprising:

a pair of jaws;

a hinge rotatably interconnecting said pair of jaws at rear end portions thereof;

a first set of pairs of rows of opposing teeth mounted on said pair of jaws, longitudinally spaced from each other and laterally oriented;

a second set of pairs of rows of opposing teeth mounted on said pair of jaws, laterally spaced from each other and longitudinally oriented;

a third set of pairs of rows of opposing teeth mounted on said pair of jaws, positioned longitudinally rearward of said second set of pairs of rows of opposing teeth and laterally spaced from each other, a first one of said third set in longitudinal alignment with a first one of said second set, a second one of said third set in longitudinal alignment with a second one of said second set.

12. The utensil of claim 11 wherein said pairs of rows of said first set of opposing teeth are approximately parallel to each other and said pairs of rows of said second set and said third set are rearwardly skewed relative to each other.

13. The utensil of claim 11 wherein each of said rows of teeth are outwardly curved to form a gap therebetween.

14. The utensil of claim 11 wherein said pair of jaws have a pair of lips at a front end portion thereof and recessed portions situated between said pairs of rows of opposing teeth to minimize contact between the food and portions of the pair of jaws other than the teeth.

15. The utensil of claim 11 wherein said pair of jaws have opposing outer surfaces which include depressions to accommodate finger tips of a user in order to facilitate manual closure of said pair of jaws and raised portions situated rearward of said depressions and outer portions situated forward of said depressions said raised portions raised to a greater degree than said outer portions in order to conform to digits of a user to direct finger pressure rearwardly to enhance firm holding of said pair of jaws and facilitate manual closure of said pair of jaws thereby enhancing gripping effectiveness thereof.

16. The utensil of claim 11 wherein said hinge is unitary and composed of plastic having sufficient flexibility to allow bending thereof upon exertion of manual pressure on said pair of jaws and thereby closure of said pair of jaws and has memory so that said hinge reverts to an extended position upon release of manual pressure on said pair of jaws thereby at least partly opening said pair of jaws.

17. The utensil of claim 11 wherein each of said teeth has a center line which is normal to a plane extending in the longitudinal and lateral directions relative to the utensil.

18. The utensil of claim 11 wherein said first set of pairs of rows of teeth have pointed portions extending longitudinally and said second and third sets of pairs of rows of teeth have pointed portions extending laterally.

19. A utensil for gripping food, comprising:

a pair of jaws rotatably interconnected so that said pair of jaws may be manually closed on the food, said pair of jaws having a first set of laterally directed pairs of rows of opposing teeth longitudinally spaced from each other and approximately parallel to each other, a second set of longitudinally directed pairs of rows of opposing teeth laterally spaced from each other and rearwardly skewed relative to each other and a third set of longitudinally directed pairs of rows of opposing teeth positioned rearward of said second set of pairs of rows of teeth, said third set of pairs of rows of teeth laterally spaced from each other.

20. A utensil for gripping food, comprising:

a pair of jaws rotatably interconnected so that said pair of jaws may be manually closed on the food, said pair of jaws having pairs of rows of opposing teeth, each pair of said pairs of rows of teeth outwardly curved to form a gap therebetween accommodating a desired portion of the food therein, said pair of jaws having a pair of lips at front end portions thereof, said pair of lips positioned forward of said pairs of rows of teeth and spaced outwardly therefrom in order to function as a guide to facilitate placement of said pair of jaws over the food and within the gap of at least one of said pairs of rows of teeth.

21. The utensil of claim 20 wherein said pair of jaws have outer surfaces which are contoured to form depressions and raised portions to conform to and accommodate front portions of a user's digits and wherein said pair of lips have outer portions which are contoured and raised outwardly from said depressions to conform to the digit tips of the user to facilitate manual closure of the pair of jaws and protect the user's digit tips to maintain cleanliness thereof.

* * * * *